US012225932B2

(12) United States Patent
Spieles et al.

(10) Patent No.: US 12,225,932 B2
(45) Date of Patent: Feb. 18, 2025

(54) CARTRIDGE FOR AN AEROSOL GENERATING DEVICE

(71) Applicant: JT International S.A., Geneva (CH)

(72) Inventors: Sandra Spieles, Trier (DE); Fabian Gafner, Zurich (CH)

(73) Assignee: JT International S.A. (CH)

( * ) Notice: Subject to any disclaimer, the term of this patent is extended or adjusted under 35 U.S.C. 154(b) by 579 days.

(21) Appl. No.: 17/603,793

(22) PCT Filed: May 20, 2020

(86) PCT No.: PCT/EP2020/064184
§ 371 (c)(1),
(2) Date: Oct. 14, 2021

(87) PCT Pub. No.: WO2020/239599
PCT Pub. Date: Dec. 3, 2020

(65) Prior Publication Data
US 2022/0211101 A1 Jul. 7, 2022

(30) Foreign Application Priority Data
May 29, 2019 (EP) ..... 19177395

(51) Int. Cl.
*A24F 40/20* (2020.01)
*A24F 40/42* (2020.01)
*A24F 40/46* (2020.01)

(52) U.S. Cl.
CPC ..... *A24F 40/20* (2020.01); *A24F 40/42* (2020.01); *A24F 40/46* (2020.01)

(58) Field of Classification Search
CPC ..... A24F 40/20; A24F 40/46; A24F 40/42; A24F 40/40
See application file for complete search history.

(56) References Cited

U.S. PATENT DOCUMENTS

| | | | | |
|---|---|---|---|---|
| 11,224,253 | B2 * | 1/2022 | Fernando | A24F 1/30 |
| 2008/0092912 | A1 * | 4/2008 | Robinson | H05B 3/42 131/200 |
| 2015/0335062 | A1 | 11/2015 | Shinkawa et al. | |
| 2017/0143042 | A1 | 5/2017 | Batista et al. | |
| 2017/0164657 | A1 | 6/2017 | Batista | |

(Continued)

FOREIGN PATENT DOCUMENTS

| | | | |
|---|---|---|---|
| EP | 2939553 | A1 | 11/2015 |
| JP | 2017520245 | A | 7/2017 |

(Continued)

OTHER PUBLICATIONS

International Search Report for PCT/EP2020/064184 dated Aug. 11, 2020. 4 pgs.

*Primary Examiner* — Harshad C Patel
(74) *Attorney, Agent, or Firm* — Lerner David LLP

(57) ABSTRACT

A cartridge for an aerosol generating device includes a slab of aerosol generating substrate having two major surfaces, two edge surfaces, and front and rear end surfaces. Each major surface has an area which is between 100 $mm^2$ and 2000 $mm^2$, and the thickness of the slab is between 0.5 mm and 3.0 mm. A wrapper is wrapped around the slab, and the wrapper extends from the front end face of the slab in order to form a mouthpiece.

14 Claims, 8 Drawing Sheets

(56) References Cited

U.S. PATENT DOCUMENTS

| | | | | |
|---|---|---|---|---|
| 2018/0168228 | A1* | 6/2018 | Reevell | A24F 40/48 |
| 2018/0168230 | A1* | 6/2018 | Reevell | A24F 40/30 |
| 2018/0168231 | A1* | 6/2018 | Reevell | A61M 15/06 |
| 2018/0169357 | A1* | 6/2018 | Reevell | A61M 15/06 |
| 2018/0360099 | A1 | 12/2018 | Ibrahim | |

FOREIGN PATENT DOCUMENTS

| | | | |
|---|---|---|---|
| JP | 2017520263 | A | 7/2017 |
| JP | 2019503659 | A | 2/2019 |
| NO | 2016005601 | A1 | 1/2016 |
| WO | 2014104078 | A1 | 7/2014 |
| WO | 2016005533 | A1 | 1/2016 |
| WO | 2016050873 | A1 | 4/2016 |
| WO | 2017202965 | A1 | 11/2017 |
| WO | 2019073237 | A1 | 4/2019 |
| WO | 2019162507 | A1 | 8/2019 |
| WO | 2020152295 | A1 | 7/2020 |

* cited by examiner

CARTRIDGE FOR AN AEROSOL GENERATING DEVICE

CROSS-REFERENCE TO RELATED APPLICATIONS

The present application is a national phase entry under 35 U.S.C. § 371 of International Application No. PCT/EP2020/064184, filed May 20, 2020, published in English, which claims priority to European Application No. 19177395.1 filed May 29, 2019, the disclosures of which are incorporated herein by reference.

BACKGROUND OF THE INVENTION

The present invention relates to a cartridge for an aerosol generating device. In particular, the invention relates to a cartridge comprising an aerosol generating substrate such as tobacco that can be heated to generate an aerosol rapidly when heating is applied.

Devices which heat, rather than burn, an aerosol generating material to produce an aerosol for inhalation have become popular with consumers in recent years. Typically a cartridge that includes the aerosol generating material is provided within an aerosol generating device that can be used to generate heat. Such devices can use one of a number of different approaches to provide heat to the aerosol generating material. One such approach is to provide an aerosol generating device which employs an induction heating system and into which an aerosol generating article, comprising aerosol generating material, can be removably inserted by a user. In such a device, an induction coil is provided with the device and an induction heatable susceptor is provided with the aerosol generating article. Electrical energy is provided to the induction coil when a user activates the device which in turn generates an alternating electromagnetic field. The susceptor couples with the electromagnetic field and generates heat which is transferred, for example by conduction, to the aerosol generating material and an aerosol is generated as the aerosol generating material is heated. In another approach a resistive heater is provided close to the aerosol generating material and heating is applied by conduction, convection, radiation or some combination of these. In this way, the aerosol generating material can be heated which in turn generates an aerosol for inhalation by a user.

In both of these kinds of devices there can be a delay between the start of heating the aerosol generating substrate and the generation of the aerosol. This delay can arise because of the need to raise the temperature of the aerosol generating substrate before any aerosol is generated. It is desirable to minimise the length of this delay in order to improve the user experience. An object of the present invention is to address some of these issues.

BRIEF SUMMARY OF THE INVENTION

According to an aspect of the invention there is provided a cartridge for an aerosol generating device, comprising: a slab of aerosol generating substrate having two major surfaces, two edge surfaces, and front and rear end surfaces, wherein each major surface has an area which is between 100 $mm^2$ and 2000 $mm^2$, and wherein the thickness of the slab is between 0.5 mm and 3.0 mm.

The slab of aerosol generating substrate may have a length of 10 mm to 40 mm, more preferably 10 mm to 20 mm, a width of 10 mm to 50 mm, more preferably 10 mm to 30 mm and a thickness of 0.5 mm to 3.0 mm. The surface area of each major surface may be preferably between 100 $mm^2$ to 1600 $mm^2$, more preferably from 100 $mm^2$ to 1000 $mm^2$, and even more preferably from 100 $mm^2$ to 600 $mm^2$.

The front and rear end surfaces are preferably configured to be exposed to an airflow when the cartridge is installed in the aerosol generating device. The airflow is preferably in a direction that is generally parallel to a surface normal of the front and rear end surfaces. In this way, a user can generate an airflow through or past the slab of aerosol generating substrate in order to inhale an aerosol in the aerosol generating device.

The thickness of the slab is preferably the distance from one major surface to the other major surface. The slab preferably has a shape which is a cuboid or a rectangular prism. It has been found advantageous to provide a thin slab with a small total volume, but which has a large major surface area. In this way, heat can be applied through the at least one of the major surfaces and the temperature of the slab can be increased rapidly in order to produce a required volume of vapour. In some arrangements it has been found that a vapour can be produced within around 10 seconds from the time at which heat is first applied.

The aerosol generating substrate may be any suitable substance capable of forming a vapour. The substance may be solid or semi-solid. The substance may comprise plant derived material and in particular, the substance may comprise tobacco. Example types of vapour generating solids include powder, granules, pellets, shreds, strands, porous material, foam or sheets. The slab can be formed by these kinds of aerosol generating substrate, which comprise tobacco.

The aerosol generating substrate may comprise tobacco foam, which may be a semi-solid mousse. Tobacco foam may comprise a plurality of fine tobacco particles and can also comprise a volume of water and/or a moisture additive, such as a humectant and/or a foam forming agent (e.g. agar, gellan gum, lecithin, polyglycerol esters of fatty acids, glycerol esters of fatty acids) and/or binder (e.g. carboxymethyl cellulose). The tobacco foam may be porous, and may allow a flow of air and/or vapour through the foam.

The aerosol generating substrate may comprise an aerosol-former. Examples of aerosol-formers include polyhydric alcohols and mixtures thereof such as glycerine or propylene glycol. Typically, the aerosol generating substrate may comprise an aerosol-former content of between approximately 5% and approximately 50% on a dry weight basis, preferably between 10% and 20%, more preferably approximately 15±2%.

Preferably the cartridge comprises a wrapper extending around the two major surfaces and the two edge surfaces. The wrapper can advantageously prevent the aerosol generating substrate from adhering to the surface of a heater, and this can be formed conveniently by wrapping around the two major surfaces and the two edge surfaces. This can help to keep the device clean and it means that the cartridge can be easily and hygienically removed and replaced. In certain embodiments it may be possible to prevent the aerosol generating substrate from adhering to a heater by providing a planar film or cover on the major surfaces which would be adjacent the heater.

Preferably the wrapper has a thickness which is between 10 nm and 1000 nm. The wrapper is preferably a paper or paper-based material. The use of such a wrapper may allow the paper to absorb some of the generated aerosol which can help to keep the device clean. In embodiments the wrapper may be a tubular case or sleeve which contains the aerosol generating substrate.

The wrapper may include an overlapping portion on one of the edge surfaces. This can allow two ends of the wrapper to be joined together securely. For example, the two ends can be glued together in the overlapping portion. This may advantageously improve the rigidity of the slab. Preferably the overlapping portion is only on at least one of the edge surfaces, and is not present on the major surfaces. Additionally, the overlapping portion could potentially obstruct the supply of heat to the slab through the major surfaces, and this is reduced by providing the overlap only on the edge surfaces.

The wrapper may include an end of overlapping portion only on at least one of the edge surfaces. By providing the end of overlapping portion only on the edge surfaces (not on major surface) of the slab it is possible to achieve even wrapper thickness on the major surfaces. This can advantageously improve the uniformity with which heat is applied to the slab across the major surface.

The wrapper may include two ends which face one another without overlapping one another. In this way, the wrapper can have a consistent thickness around the two major surfaces and the two edge surfaces. This means that the wrapper presents a substantially equal obstacle to heating around outer surfaces of the slab. In some embodiments the wrapper may be configured as a continuous sleeve which can receive the slab.

In a further alternative arrangement the wrapper may include two ends, at least one of which is provided on at least one of the major surfaces, either in an overlapping configuration or otherwise. This configuration may be preferred because the edge surfaces may be small (with a thickness of only around 0.5 mm). This means that it may be difficult to secure the ends of the wrapper adequately if they are provided on the edge surfaces. This may improve the integrity of the wrapper which can further improve the robustness of the cartridge. In addition, this approach may improve the ease of manufacture. In an embodiment where there is a wrapper overlap an inner end of the wrapper may be covered by the overlapping portion, and an outer end of the wrapper may be exposed. The outer end may be provided on one of the major surfaces so that the wrapper overlap extends partially across the major surface. In some configurations both the inner end and the outer end of the wrapper may be provided on one of the major surfaces.

In some embodiments an adhesive is provided between the wrapper and the aerosol generating substrate. The adhesive may be a glue.

An airflow route is preferably provided from the rear end surface to the front end surface, and the airflow route is preferably provided between the wrapper and the aerosol generating substrate. In this way, the airflow can be provided across the surface of the aerosol generating substrate so that generated aerosol can be collected more effectively and entrained in the air which flows towards the user.

In one configuration the airflow route may be provided between at least one of the two edge surfaces and the wrapper. In another configuration the airflow route may be provided between at least one of the two major surfaces and the wrapper.

The airflow route may be provided by one or more grooves or channels in the aerosol generating substrate. The channels in the aerosol generating substrate may include holes which extend from one major surface to the other, and/or from one edge surface to the other, and/or from the front end surface to the rear end surface, and which promote an airflow that is internal to the slab.

In another configuration the airflow route may be provided by one or more grooves in the wrapper (or planar film or cover which is provided on the at least one major surface). By providing a groove on the inner side of wrapper, the air flow route may be provided between the wrapper and aerosol generating substrate. Whereas, by providing a groove on the outer side of wrapper, the airflow route may be provided between the wrapper and the heater when the cartridge is received in the aerosol generating device. In both cases this can improve the extraction of vapour from aerosol generating substrate to user.

The wrapper may extend from the front surface of the slab in order to form a mouthpiece through which a user can generate an airflow past or through the slab in order to inhale an aerosol. This may desirably separate the user's mouth from the slab in order to allow the aerosol to cool in the mouthpiece. The mouthpiece may project through an opening in the housing of the aerosol generating device when the cartridge is installed within the aerosol generating device.

The mouthpiece preferably comprises an internal supporting structure. This can prevent the mouthpiece from being crushed when it is received in a user's mouth. The internal supporting structure can also help to maintain the cross-sectional shape of the mouthpiece as it extends from the front surface of the slab. Further, the internal supporting structure can help improve the structural rigidity of the slab of aerosol generating material, which can also be contained within the same wrapper.

The internal supporting structure may be a corrugated support structure. In two examples, the corrugated support structure may be waved ridged paper or corrugated paper. In an alternative arrangement the internal supporting structure may be a block of material, such as a filter material made of paper or fibres. For example, an acetate filter may be used.

The wrapper may also extend from the rear surface of the slab to form an air inlet portion. This may be desirable for the sake of manufacturing efficiency. A number of cartridges may be constructed together in a line and these can be cut in the mouthpiece section to form individual cartridges. The wrapper extension from the rear surface of the slab may therefore correspond to what would have been the mouthpiece section of an adjacent cartridge. It is desirable to reduce the precision required in the accuracy of the cutting position, and this reduction in accuracy may produce the rear extension as an artefact. Extending the wrapper from the rear surface of the slab may also be advantageous in securing the slab within the cartridge.

The cartridge preferably includes a support element for increasing the rigidity of the slab in a plane that is parallel to the two major surfaces. In one arrangement the wrapper may offer structural support to help prevent the thin slab from bending. This may be achieved by providing the wrapper around the two edge surfaces, since increasing the rigidity of the edges may reduce the risk of the slab bending in a longitudinal direction. The wrapper may include folds along the vertices between the major surfaces and the edge surfaces. These folds may advantageously provide additional structural support for the slab. In another configuration the support element may comprise a lattice in two or three dimensions around which the slab is formed; this may improve the rigidity of the slab.

According to another aspect of the invention there is provided an aerosol generating device, comprising: the cartridge as previously defined; and a heater positioned adjacent at least one of the major surfaces. The heater may be a resistive heater. The resistive heater may have an area which is approximately the same as the area of one of the major surfaces. There may be two resistive heaters adjacent respective major surfaces.

The aerosol generating device may have a main body with a hinged lid that can be opened to accept the cartridge. It is advantageous to provide a hinged lid because it provides easy access to the heating chamber and heating surfaces. This can permit easy maintenance and cleaning of the heating chamber; for example, it can allow easy access that would allow a user to remove any foreign bodies that are accidentally introduced through an opening in the main body. Preferably the mouthpiece portion of the cartridge extends through an opening in the main body, or defined by the main body and lid, for ease of access by a user.

According to another aspect of the invention there is provided a method of manufacturing a cartridge for an aerosol generating device, the method comprising: providing a slab of aerosol generating substrate having two major surfaces, two edge surfaces, and front and rear end surfaces which can be exposed to an airflow, wherein each major surface may have an area which is between 100 $mm^2$ and 2000 $mm^2$, and wherein the thickness of the slab may be between 0.5 mm and 3.0 mm.

Preferably the method further includes providing a wrapper around the two major surfaces and the two edge surfaces. The method may also include extending the wrapper from the front surface of the slab in order to form a mouthpiece through which a user can generate an airflow past or through the slab in order to inhale an aerosol. A plurality of cartridges may be produced together and the method may include cutting the cartridges in the mouthpiece portion in order to produce individual cartridges.

According to yet another aspect of the invention there is provided a cartridge for an aerosol generating device, the cartridge comprising: a slab of aerosol generating substrate having two major surfaces, two edge surfaces, and front and rear end surfaces which can be exposed to an airflow; and a wrapper which is wrapped around the slab, wherein the wrapper extends from the front surface of the slab in order to form a mouthpiece through which a user can generate an airflow past or through the slab in order to inhale an aerosol.

According to yet another aspect of the present invention there is provided a method of manufacture of a cartridge for an aerosol generating device, the method comprising the steps of: providing a slab of aerosol generating substrate having two major surfaces, two edge surfaces, and front and rear end surfaces which can be exposed to an airflow; and wrapping a wrapper around the slab, wherein the wrapper extends from the front surface of the slab in order to form a mouthpiece through which a user can generate an airflow past or through the slab in order to inhale an aerosol.

Optional features of the aspects of the invention described above may be combined in any convenient way. In addition, apparatus features may be provided as method features/steps and vice-versa.

BRIEF DESCRIPTION OF THE DRAWINGS

Embodiments of the invention will now be described by way of example only with reference to the following drawings.

DETAILED DESCRIPTION

In the context of the present disclosure, an aerosol and a vapour can be considered interchangeable expressions. That is, an aerosol is a vapour and a vapour is an aerosol. An aerosol for smoking may refer to an aerosol with particle sizes of 0.5-7 microns. The particle size may be less than 10 or 7 microns.

Figure 1A:
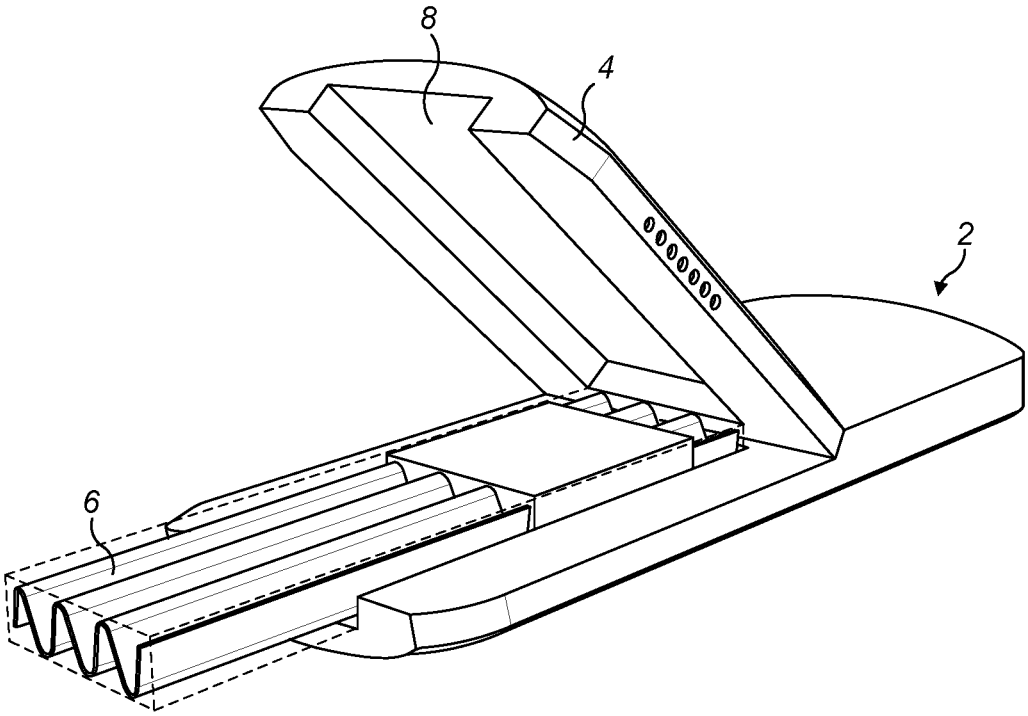
FIG. 1A is a perspective view of an aerosol generating device in an open configuration with a cartridge in position in an embodiment of the invention.
Figure 1B:
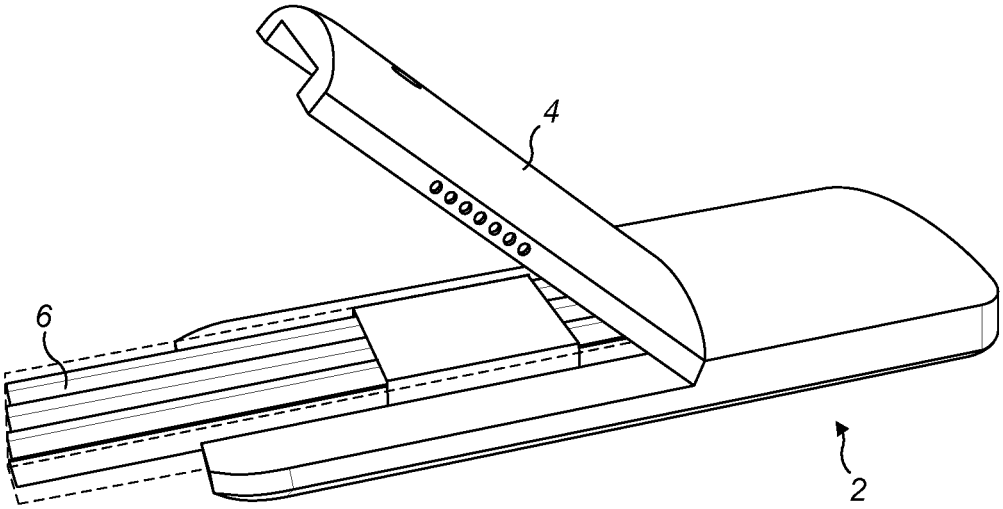
FIG. 1B shows the aerosol generating device of FIG. 1A from a different perspective.
Figure 2A:
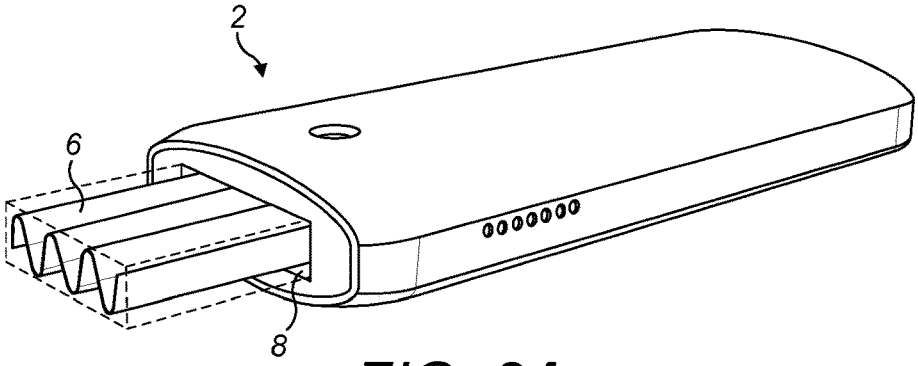
FIG. 2A is a perspective view of an aerosol generating device in an closed configuration with a cartridge installed within in an embodiment of the invention.
Figure 2B:
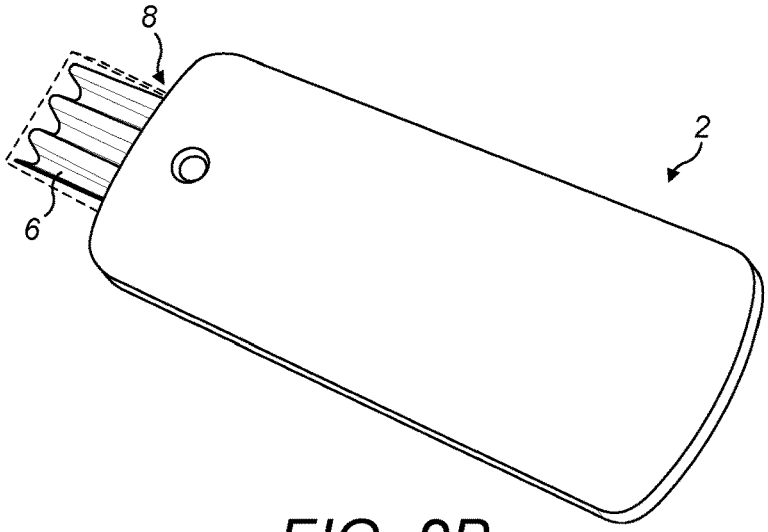
FIG. 2B shows the aerosol generating device of FIG. 2A from a different perspective.
Figure 3:
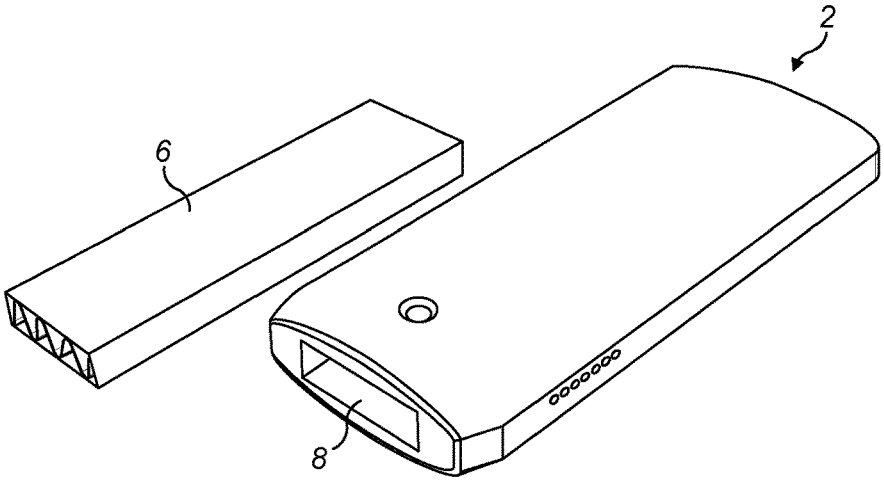
FIG. 3 is a perspective view of an aerosol generating device in an closed configuration and a cartridge to one side in an embodiment of the invention.

FIGS. 1A and 1B are perspective views of an aerosol generating device 2 in an open configuration. FIGS. 2A and 2B are perspective views of the aerosol generating device 2 in a closed configuration. The aerosol generating device 2 includes a hinged lid 4 that can be opened for insertion or removal of a cartridge 6 which contains an aerosol generating substrate such as tobacco. The hinged lid 4 can be closed in order to grip the cartridge 6 and secure it in position. With the hinged lid 4 in its open position, a depleted cartridge 6 can be removed, and a fresh cartridge 6 can be fitted in its place.

The aerosol generating device 2 includes an internal cavity which is shaped and sized to receive the cartridge 6. The cartridge 6 is sized such that it fits within the internal cavity and projects through an opening 8 in the housing of the aerosol generating device 2 in order to form a mouthpiece 20.

Figure 4:
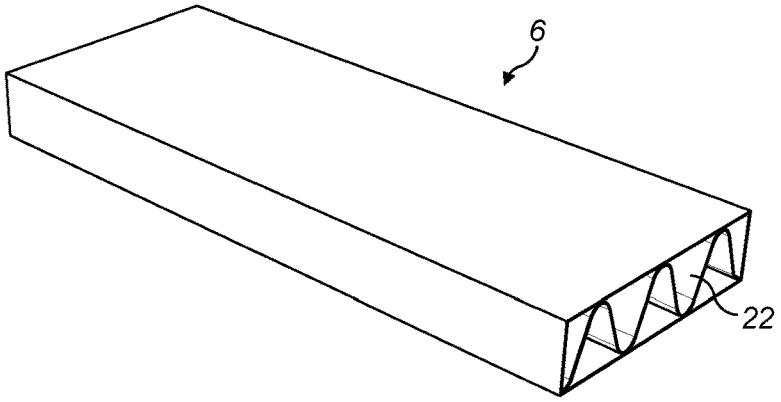
FIG. 4 is a perspective view of a cartridge for an aerosol generating device in another embodiment of the invention.
Figure 5:
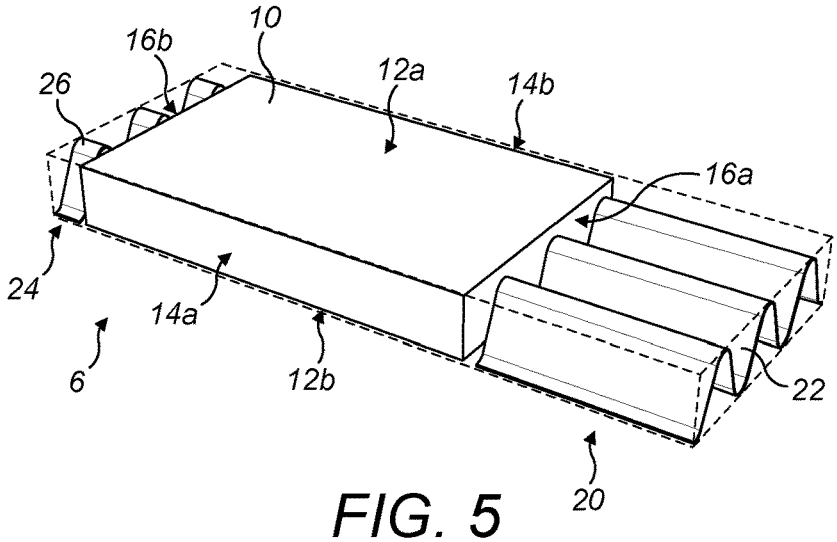
FIG. 5 is a perspective view showing the cartridge of FIG. 4 but with a transparent outer wrapper.
Figure 6:
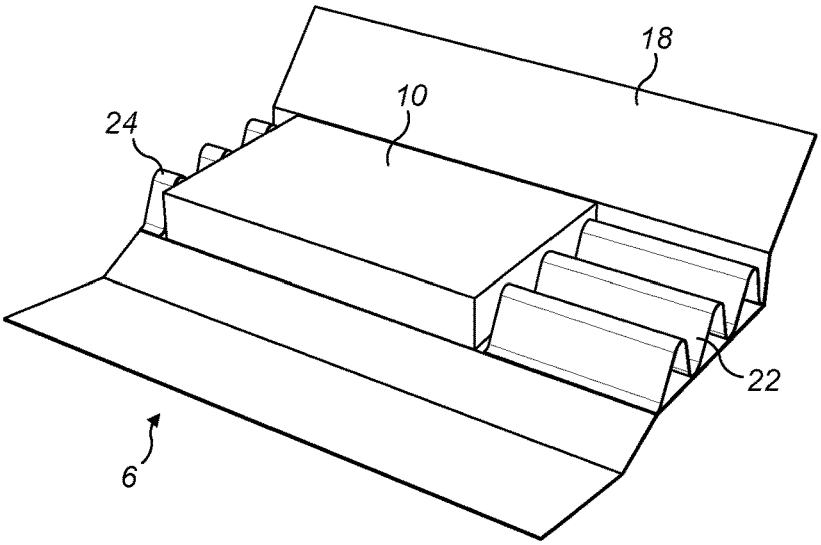
FIG. 6 is a perspective view showing the cartridge of FIG. 4 in a partially unwrapped configuration.

Further details of the cartridge 6 are apparent from FIGS. 4 to 6. The cartridge 6 includes an aerosol generating substrate 10 that includes tobacco. The aerosol generating substrate 10 can be solid or semi-solid. Example types of vapour generating solids include powder, granules, pellets, shreds, strands, porous material, foam or sheets.

In a preferred arrangement the aerosol generating substrate 10 is tobacco foam, which may be a semi-solid mousse. Tobacco foam typically comprises a plurality of fine tobacco particles and can typically also comprise a volume of water and/or a moisture additive, such as a humectant. The tobacco foam may be porous, and may allow a flow of air and/or vapour through the foam.

The aerosol generating substrate 10 may comprise an aerosol-former. Examples of aerosol-formers include polyhydric alcohols and mixtures thereof such as glycerine or propylene glycol. Typically, the aerosol generating substrate may comprise an aerosol-former content of between approximately 5% and approximately 50% on a dry weight basis. Preferably, the aerosol generating substrate may comprise an aerosol-former content of approximately 15% on a dry weight basis.

The aerosol generating substrate 10 is a slab of material having a shape which is a substantial cuboid or rectangular prism. The aerosol generating substrate 10 has two major surfaces 12*a,b*, two edge surfaces 14*a,b*, and front and rear end surfaces 16*a,b*. The aerosol generating substrate 10 typically has a length of 10 mm to 40 mm, more preferably 10 mm to 20 mm, a width of 10 mm to 50 mm, more preferably 10 mm to 30 mm and a thickness of 0.5 mm to 3.0 mm. The surface area of each major surface is between 100 $mm^2$ and 2000 $mm^2$, more preferably from 100 $mm^2$ to 1600 $mm^2$, more preferably from 100 $mm^2$ to 1000 $mm^2$, and even more preferably from 100 $mm^2$ to 600 $mm^2$.

The slab of aerosol generating substrate 10 is provided within a wrapper 18, which may be an air permeable material, and is preferably made of paper having a thickness of between 10 nm and 1000 nm. The wrapper 18 extends around the two major surfaces 12*a,b* and the two edge surfaces 14*a,b*. The wrapper 18 includes a paper fold at the vertices between the major surfaces 12*a,b* and the edge surfaces 14*a,b*, and this paper fold can advantageously improve the overall rigidity of the cartridge 6 to reduce the risk of bending and to help maintain the major surfaces 12*a,b* in a flat configuration. The front and rear end surfaces 16*a,b* are not covered by the wrapper 18 so that they can be exposed to an airflow within the aerosol generating device 2. The wrapper 18 can advantageously prevent the aerosol generating substrate 10 from adhering to a heater 30, 32 within the aerosol generating device 2. Glue (or some other adhesive) can be provided between the wrapper 18 and the aerosol generating substrate 10. The wrapper 18 may not be air permeable in some arrangements, but may have holes or perforations that can allow an air flow.

In one embodiment the wrapper 18 includes an overlapping portion on one of the edge surfaces 14*a,b*. In this way, the wrapper 18 can be secured in position by adhering the overlapping portion of the wrapper 18 to the remainder of the wrapper along one of the edge surface 14*a,b*. Advantageously the overlapping portion is only on one of the edge surfaces 14*a,b* and does not extend onto either of the major surfaces 12*a,b*. This ensures that the wrapper 18 has even thickness along the major surfaces 12*a,b* so that heat can be evenly received by the aerosol generating substrate 10 through the major surfaces 12*a,b*. The overlapping portion of the wrapper 18 can also advantageously improve the rigidity of the aerosol generating substrate 10, reducing the likelihood of bending.

In another embodiment the wrapper 18 does not include an overlapping portion. In such a configuration the wrapper 18 can have two ends which face one another without overlapping. In this way, the wrapper 18 can have a consistent thickness around the two major surfaces 12*a,b* and the two edge surfaces 14*a,b*. This means that the wrapper 18 presents a substantially equal thickness around the aerosol generating substrate 18. In another embodiment the wrapper 18 may be configured as a continuous sleeve which extends around the aerosol generating substrate 10. In other embodiments the wrapper 18 may be implemented as a cover or film which is provided only on the major surfaces 12*a,b*, or only on one of the major surfaces 12*a,b*.

In yet another configuration, the wrapper 18 can have two ends which are provided on one of the major surfaces 12*a,b*. The ends can be provided in an overlapping configuration or otherwise. This may improve the integrity of the wrapper 18 and reduce the risk of the wrapper 18 unpeeling. This approach may improve the ease of manufacture because it may be simpler to join the two wrapper ends against one of the major surfaces 12*a,b* than against one of the edge surfaces 14*a,b*, since these edge surfaces may be relatively small.

The cartridge 6 includes a mouthpiece portion 20 extending from the front end surface 16*a* of the aerosol generating substrate 10. The mouthpiece portion 20 is formed by the wrapper 18 extending around a first corrugated paper block 22, which helps the mouthpiece portion 20 maintain the same cross-sectional shape as that of the aerosol generating substrate 10. The first corrugated paper block 22 helps to maintain the shape of the mouthpiece portion 20 so that it is resistant to crushing when received in a user's mouth. The first corrugated paper block 22 also helps to maintain the structural rigidity of the thin aerosol generating substrate 10 within the overall cartridge 6 to reduce the likelihood of bending. In other embodiments the first corrugated paper block 22 may be replaced by other kinds of material that similarly permit an airflow from the front end surface 16*a* of the aerosol generating substrate 10 to the open end of the mouthpiece portion 20; for example, the first corrugated paper block 22 may be replaced by a block of porous filter material or a plurality of struts, each of which can help to maintain the cross-sectional shape of the mouthpiece portion 20, and to provide a structure that the wrapper 18 can bear against while it is wrapped around the aerosol generating substrate 10. The mouthpiece portion 20 has a length of approximately 10 mm to 25 mm, more preferably 10 mm to 20 mm, from the front end surface 16*a* of the aerosol generating substrate 10 to the open end of the cartridge 6. The mouthpiece portion 20 can separate the user's mouth from the slab of aerosol generating substrate 10, and this can permit some cooling of the generated aerosol in the mouthpiece portion 20 before it is received in the user's mouth. It has been found that this cooling effect can improve the user experience.

The cartridge 6 also includes an air inlet portion 24 extending from the rear end surface 16*b* of the aerosol generating substrate 10. The air inlet portion 24 is formed by the wrapper 18 extending around a second corrugated paper block 26 which helps the air inlet portion 24 maintain the same cross-sectional shape as that of the aerosol generating substrate 10. In a similar way, as described above in relation to the first corrugated paper block 22, the second corrugated paper block 26 can help to maintain the structural rigidity of the thin aerosol generating substrate 10 within the overall cartridge 6 to reduce the likelihood of bending. The second corrugated paper block 26 could also be replaced by another material that permits an air flow. In use, an air flow can be carried into the cartridge 6 through the air inlet portion 24. The air inlet portion 24 has a length of approximately 5 mm to 10 mm, from the rear end surface 16*b* of the aerosol generating substrate 10 to the open rear end of the cartridge 6.

Figure 7A:
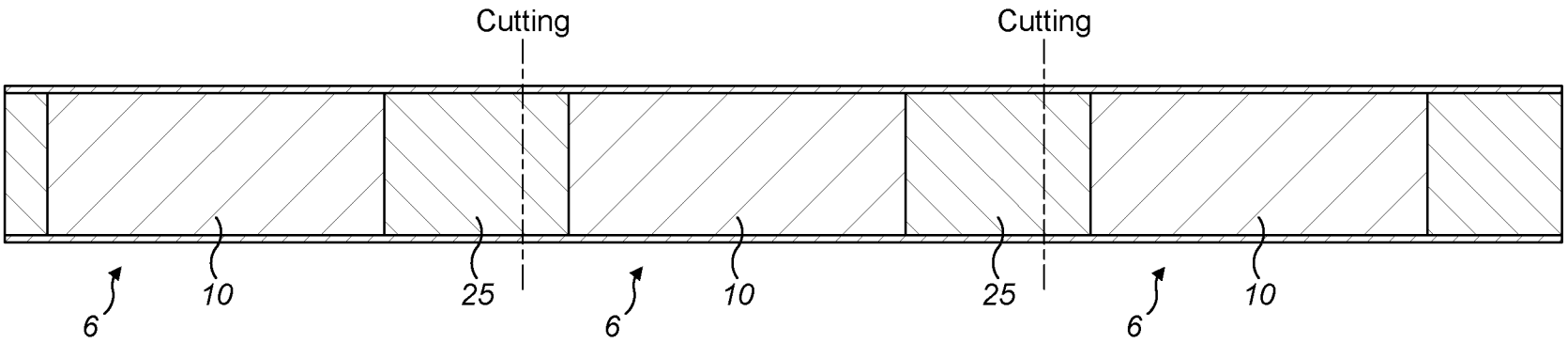
FIG. 7A is a top view of a plurality of cartridges produced in a single line in an embodiment of the invention.
Figure 7B:
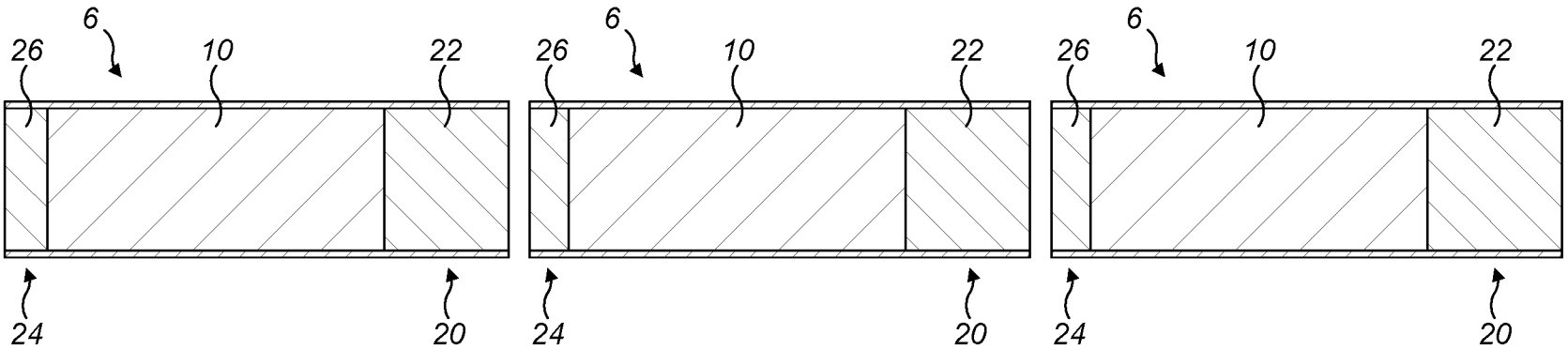
FIG. 7B shows the plurality of cartridges of FIG. 7A after they have been separated into individual cartridges.

FIG. 7A is a top view of a plurality of cartridges 6 produced in a single line in an embodiment of the invention. FIG. 7B shows the plurality of cartridges 6 of FIG. 7A after they have been separated. The cartridges 6 are produced by providing a plurality of slabs of aerosol generating substrate 10 in a line, separated from one another with corrugated paper blocks 25. The slabs of aerosol generating substrate 10 and corrugated paper blocks 25 are wrapped in the wrapper 18 in one long, thin line. The cartridges 6 are separated from one another by cutting. This may be achieved, for example, using a mechanical cutting device or an optical cutting device such as a laser. The cutting is performed at a position in the corrugated paper blocks 25, thereby to form individual cartridges 6 having a mouthpiece portion 20 with a first corrugated paper block 22 and an air inlet portion 24 with a second corrugated paper block 26. The present design means that the accuracy required in the position of the cutting line in the corrugated paper block 25 is not particularly high; for example, an accuracy may be provided of ±2 mm. This is possible because the cartridge 6 has a first corrugated paper block 22 and a second corrugated paper block 26.

This design is preferable because it avoids the need to position a cutting line close to the front or rear end surfaces 16*a,b* of the slab of aerosol generating material 10, since this would require high accuracy, which would add to manufacturing cost and increase the amount of time required in the manufacturing process.

Figure 8:
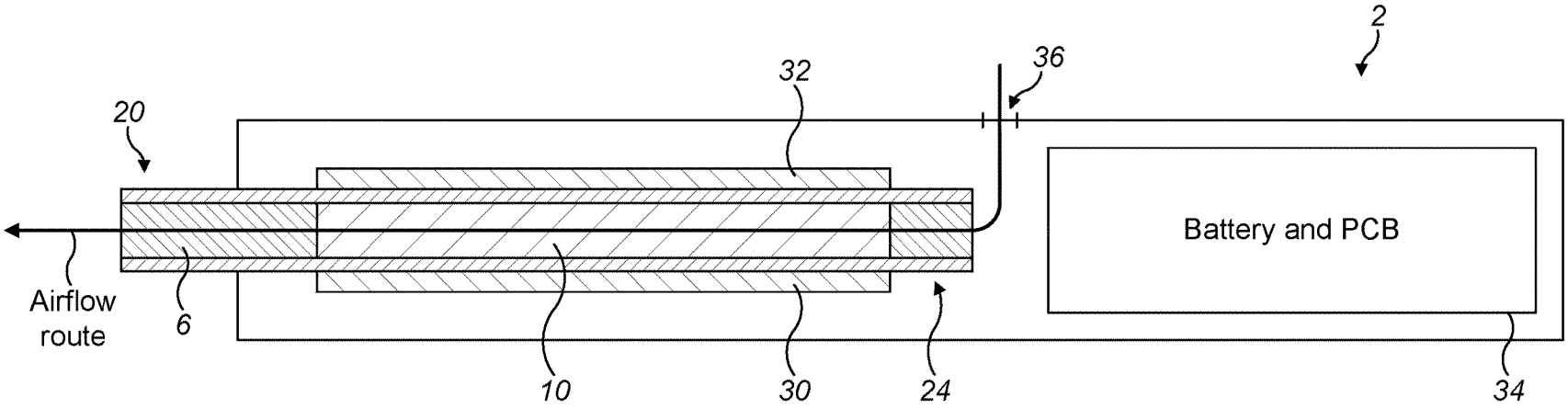
FIG. 8 is a schematic cross-sectional side view of an aerosol generating device with a cartridge installed within in an embodiment of the invention.

FIG. 8 is a schematic cross-sectional side view of the aerosol generating device 2, in an embodiment of the invention, with the cartridge 6 installed within. As can be appreciated, the mouthpiece portion 20 of the cartridge 6 extends through the hole 8 in the housing of the aerosol generating device 2 to be received by a user's mouth. In this embodiment the aerosol generating device 2 includes a first heater 30 and a second heater 32. The first heater 30 has a surface area which is between 100 $mm^2$ and 2000 $mm^2$, which is approximately equal to the surface area of the bottom major surface 12*b* of the slab of aerosol generating material 10. The second heater 32 has the same surface area, which is between 100 $mm^2$ and 2000 $mm^2$, and is positioned adjacent the top major surface 12*a* of the slab of aerosol generating material 10. The aerosol generating device 2 includes a battery and printed circuit board (PCB) 34 which includes control electronics. In use, a user can activate the first and second heaters 30, 32 in a conventional way, for example using an activation button (not shown) or using an airflow sensor (not shown). The first and second heaters 30, 32 electrically activated using electrical energy supplied by the battery 34 and the heat generated by the first and second heaters 30, 32 is supplied to the aerosol generating substrate 10 by conduction, convection, radiation or some combination of these. The aerosol generating substrate 10 is thereby heated and this causes generation of an aerosol which can be inhaled by a user via the mouthpiece portion 20. The aerosol generating device 2 includes air inlet holes 36. When a user inhales through the mouthpiece portion 20 air can be drawn into the air inlet hole 36 and through or past the aerosol generating substrate 10. In this way, generated aerosol can be entrained in the airflow that is received in the user's mouth.

Figure 9:
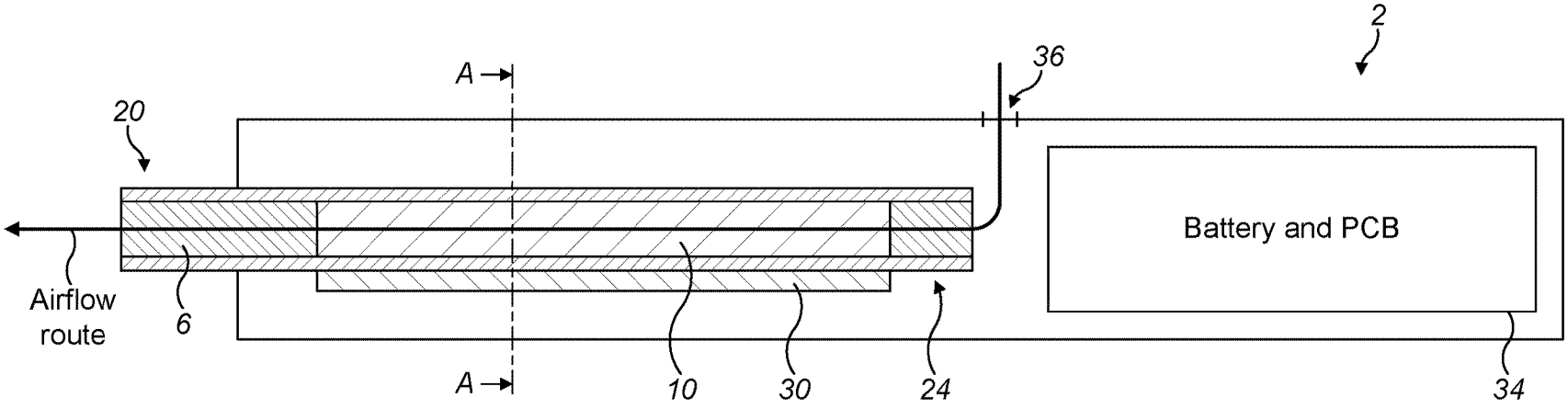
FIG. 9 is a schematic cross-sectional side view of an aerosol generating device with a cartridge installed within in another embodiment of the invention.

FIG. 9 is a schematic cross-sectional side view of the aerosol generating device 2 with a cartridge 6 installed in another embodiment of the invention. In this arrangement only the first heater 30 is present. Heat can therefore be supplied to the aerosol generating substrate 10 from one major surface 12*a,b* only.

Figure 10:
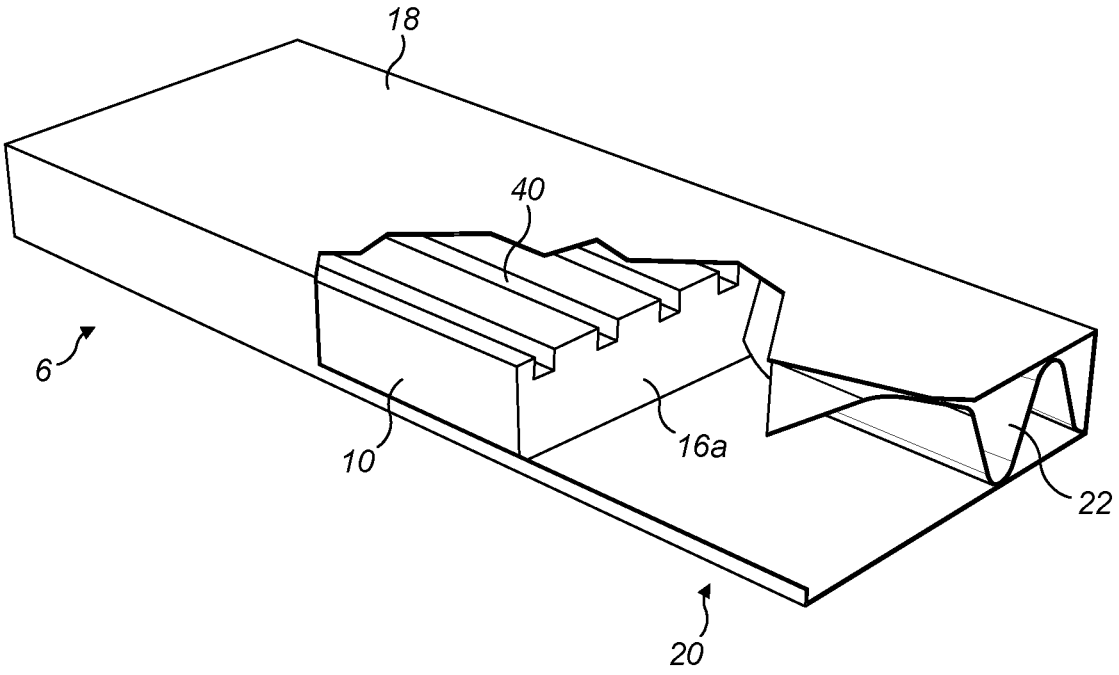
FIG. 10 is a perspective view of a cartridge for an aerosol generating device in an embodiment of the invention.
Figure 11:
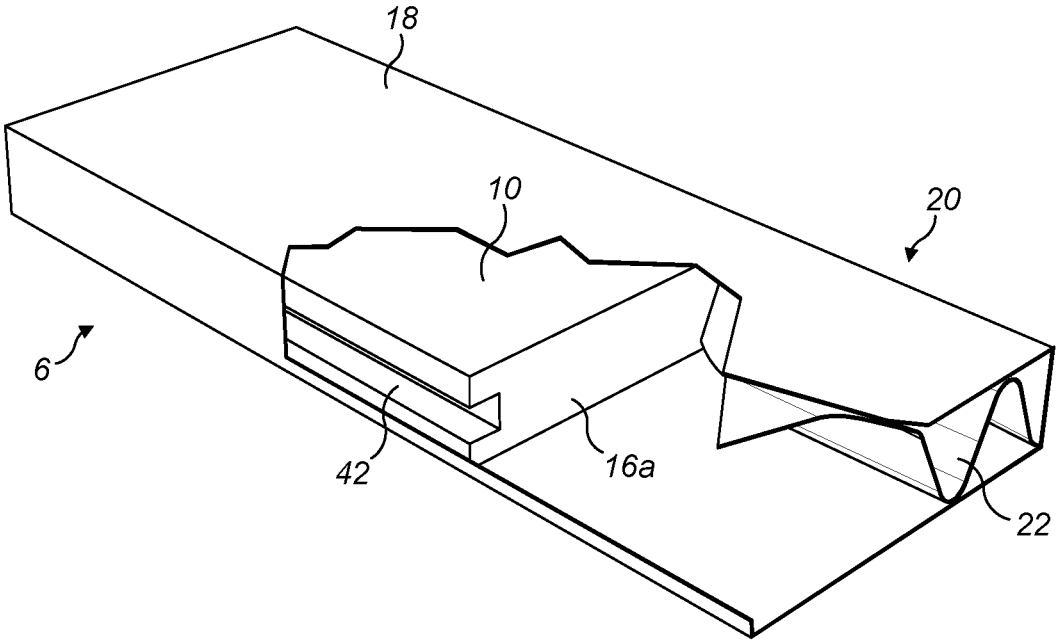
FIG. 11 is a perspective view of a cartridge for an aerosol generating device in another embodiment of the invention.
Figure 12:
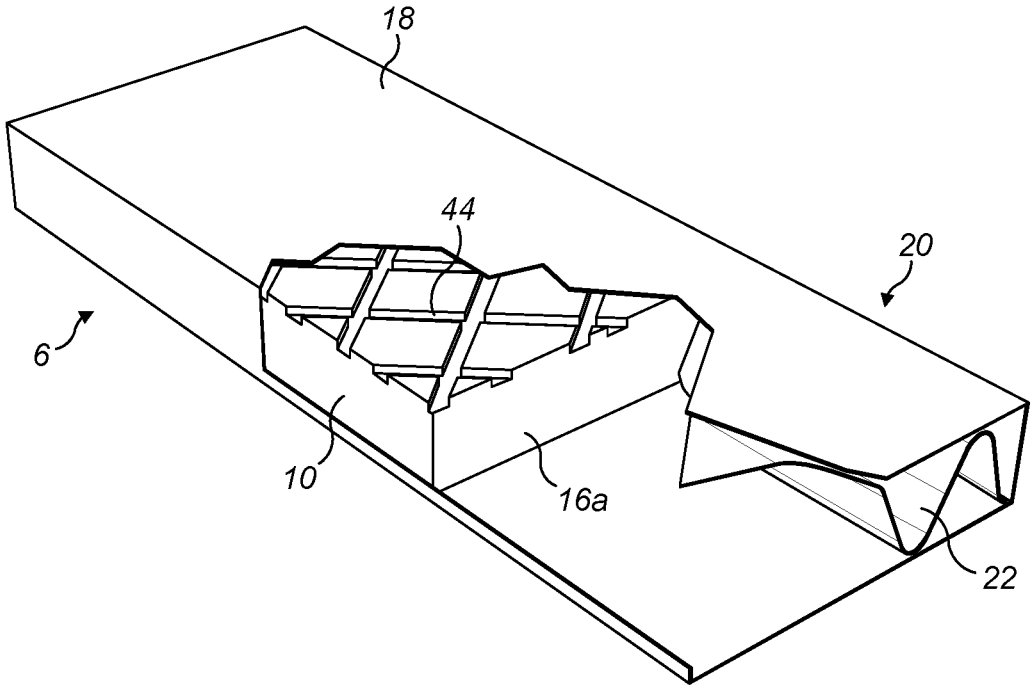
FIG. 12 is a perspective view of a cartridge for an aerosol generating device in another embodiment of the invention.

FIGS. 10 to 13 are perspective views of cartridges 6 in a number of embodiments showing different designs that can facilitate an airflow from one end of the cartridge 6 to the other, through or past the slab of aerosol generating substrate 10. The perspective views in FIGS. 10 to 13 include a cut-away portion so that internal features of the cartridges 6 are visible, beneath the wrapper 18. In FIG. 10 the slab of aerosol generating substrate 10 includes longitudinal channels 40 on one of the major surfaces 12*a,b*, extending from the rear end face 16*b* to the front end face 16*a*. In FIG. 11 the slab of aerosol generating substrate 10 includes a longitudinal channel 42 in one or both of its edge surfaces 14*a,b*, extending from the rear end face 16*b* to the front end face 16*a*. In FIG. 12 the slab of aerosol generating substrate 10 includes a cross-hatch pattern of channels 44 in at least one of its major surfaces 12*a,b*, to provide an airflow path from the rear end face 16*b* to the front end face 16*a*. The channels 40, 42, 44 provide an airflow path between the aerosol generating substrate 10 and the wrapper 18 from the rear end face 16*b* to the front end face 16*a* of the aerosol generating substrate 10. In other words, the channels 40, 42, 44 are internal to the wrapper 18. In this way, aerosol that is generated by the aerosol generating substrate 10 can be entrained in the airflow that extends in the channels 40, 42, 44 so that the aerosol can be gathered efficiently and delivered to a user. Any combination of these kinds of channels 40, 42, 44 may be provided to achieve a similar effect.

Figure 13:
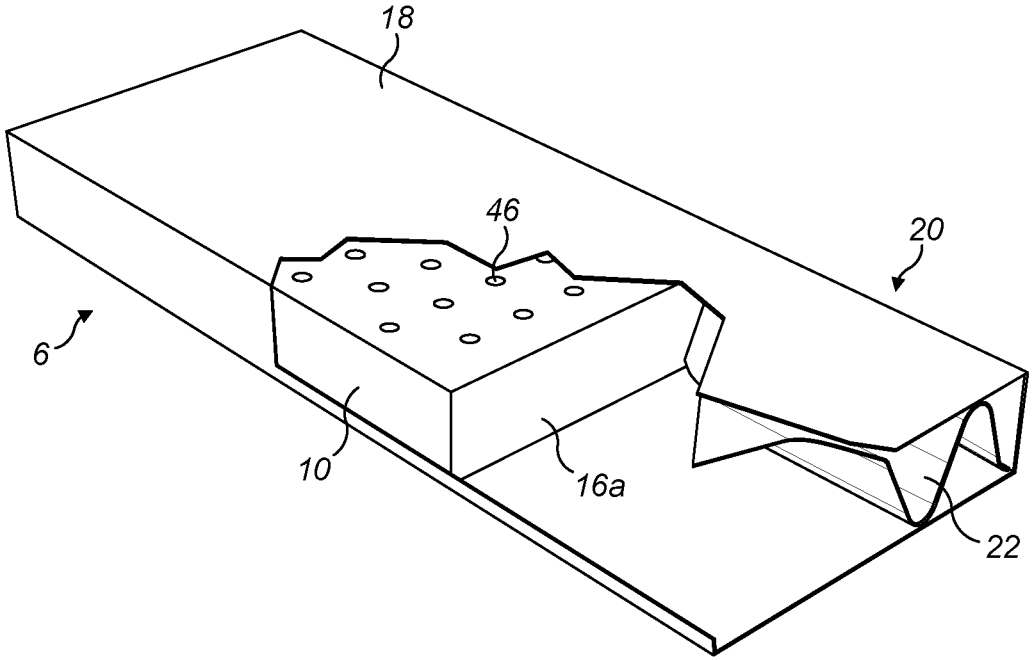
FIG. 13 is a perspective view of a cartridge for an aerosol generating device in another embodiment of the invention.

In FIG. 13 the slab of aerosol generating substrate 10 includes a plurality of through-holes 46 which extend from one major surface 12*a* to the other major surface 12*b*. These through-holes 46 facilitate an internal airflow in the slab of aerosol generating substrate 10 that can be effective in improving delivery of aerosol to the user. In other embodiments through-holes may be provided between the front and rear end faces 16*a,b* or the edge surfaces 14*a,b*. The through-holes 46 may be provided together with the channels 40, 42, 44 disclosed above in any combination.

Figure 14:
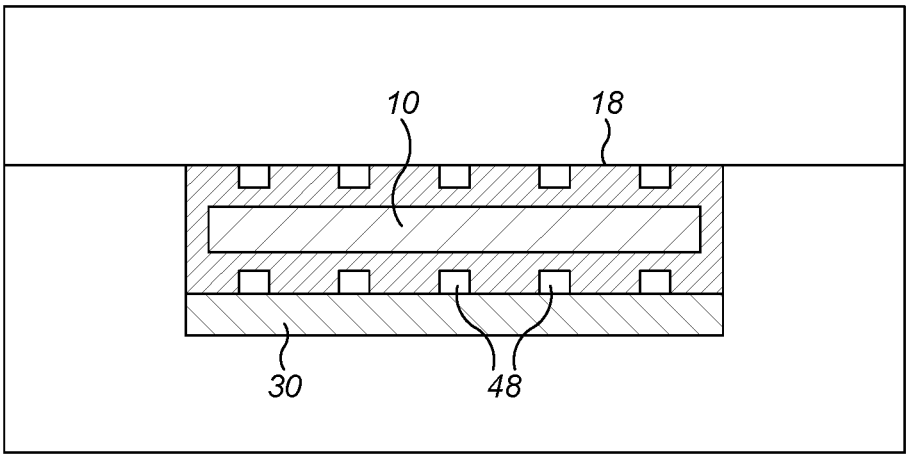
FIG. 14 is a cross-sectional end view of the aerosol generating device shown in FIG. 9 along the line A-A.

FIG. 14 is a cross-sectional end view of the aerosol generating device 2 shown in FIG. 9 including a cartridge 6 in an alternative embodiment. In this arrangement a number of grooves 48 are provided on the outer surface of the wrapper 18 on one of the major surfaces 12*a,b*. This may be achieved by providing a wrapper 18 having different thicknesses across the major surface 12*a,b*. For example, the wrapper 18 may have ridges, indentations, grooves or other surface features. This arrangement can create an airflow path between the first heater 30 and the wrapper 18, extending from the rear end face 16*b* to the front end face 16*a* of the aerosol generating substrate 10. This provides another technique for gathering generated aerosol in an airflow and delivering it to a user.

Figure 15:
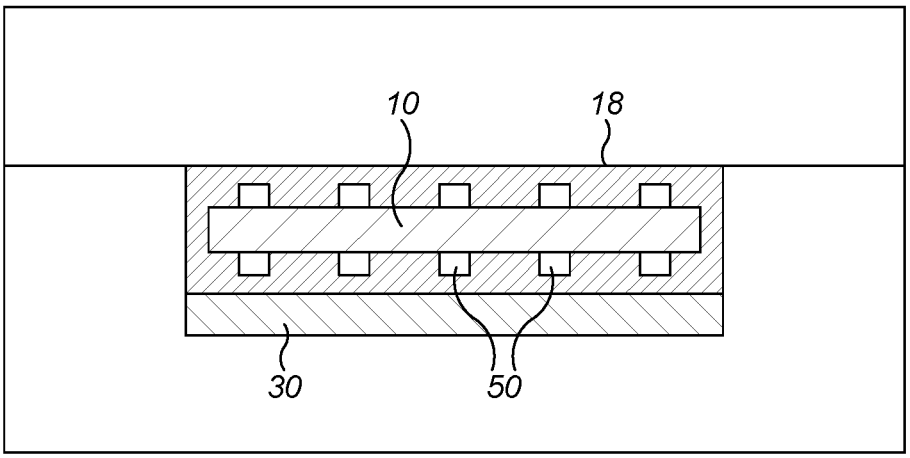
FIG. 15 is a cross-sectional end view of the aerosol generating device shown in FIG. 9 along the line A-A in a different embodiment.

FIG. 15 is a cross-sectional end view of the aerosol generating device 2 shown in FIG. 9 including a cartridge 6 in a further alternative embodiment. In this arrangement a number of grooves 50 are provided on the inner surface of the wrapper 18 on the major surfaces 12*a,b*. This may be achieved by providing a wrapper 18 having an internal surface profile on the major surfaces 12*a,b* including ridges, indentations, grooves or other surface features. This arrangement can create an airflow path between the aerosol generating substrate 10 and the wrapper 18, extending from the rear end face 16*b* to the front end face 16*a*. This provides a further technique for gathering generated aerosol in an airflow and delivering it to a user.

The present techniques provide a cartridge 6 which is thin, having a thickness of 0.5 mm to 3.0 mm. The surface area of the major surface 12*a,b* of the aerosol generating substrate 10 within the cartridge 6 is between 100 $mm^2$ and 2000 $mm^2$. This arrangement provides an aerosol generating substrate 10 with a small total volume and major surface area which is large, relative to the total volume. In other words, the ratio of major surface area to volume is high. In use, heat can be applied through at least one of the major surfaces 12*a,b*. Heat can be applied across a large surface area, and this can allow the relatively small volume to be heated rapidly, allowing the aerosol generating substrate 10 to produce a vapour with minimal delay. In some arrangements it has been found that a vapour can be produced within around 10 seconds from the time at which heat is first applied.

The invention claimed is:

1. A cartridge for an aerosol generating device, comprising:

a slab of aerosol generating substrate having two major surfaces, two edge surfaces, and front and rear end surfaces, wherein each major surface has an area which is between 100 $mm^2$ and 2000 $mm^2$, and wherein a thickness of the slab between the two major surfaces is between 0.5 mm and 3.0 mm; and a wrapper extending around the two major surfaces and the two edge surfaces so as to include a fold at vertices between the two major surfaces and the two edge surfaces, wherein the wrapper extends from the front end surface of the slab in order to form a mouthpiece through which a user can generate an airflow past or through the slab in order to inhale an aerosol.

2. A cartridge for an aerosol generating device, the cartridge comprising:

a slab of aerosol generating substrate having two major surfaces, two edge surfaces, and front and rear end surfaces which can be exposed to an airflow; and a wrapper which is wrapped around the slab so as to include a fold at vertices between the two major surfaces and the two edge surfaces and cover the two major surfaces and the two edge surfaces, wherein the wrapper extends from the front end surface of the slab in order to form a mouthpiece through which a user can generate an airflow past or through the slab in order to inhale an aerosol.

3. The cartridge of claim 2, wherein the wrapper has a thickness which is between 10 nm and 1000 nm.

4. The cartridge of claim 2, wherein the wrapper includes an overlapping portion on one of the edge surfaces.

5. The cartridge of claim 2, wherein the wrapper includes two ends which face one another without overlapping one another.

6. The cartridge of claim 2, wherein an adhesive is provided between the wrapper and the aerosol generating substrate.

7. The cartridge of claim 2, wherein an airflow route is provided from the rear end surface to the front end surface, and wherein the airflow route is provided between the wrapper and the aerosol generating substrate.

8. The cartridge of claim 7, wherein the airflow route is provided by one or more grooves or channels in the aerosol generating substrate.

9. The cartridge of claim 2, wherein the mouthpiece comprises an internal supporting structure to maintain a shape of the mouthpiece as the mouthpiece extends from the front end surface of the slab.

10. The cartridge of claim 9, wherein the internal supporting structure is a corrugated support structure.

11. The cartridge of claim 2, wherein the wrapper also extends from the rear end surface of the slab to form an air inlet portion.

12. The cartridge of claim 2, including a support element for increasing rigidity of the slab in a plane that is parallel to the two major surfaces.

13. An aerosol generating device, comprising:

the cartridge of claim 2; and a heater positioned adjacent at least one of the major surfaces.

14. A method of manufacturing a cartridge for an aerosol generating device, the method comprising:

providing a slab of aerosol generating substrate having two major surfaces, two edge surfaces, and front and rear end surfaces which can be exposed to an airflow, wherein each major surface has an area which is between 100 $mm^2$ and 2000 $mm^2$, and wherein a thickness of the slab between the two major surfaces is between 0.5 mm and 3.0 mm, extending a wrapper around the two major surfaces and the two edge surfaces so as to include a fold at vertices between the two major surfaces and the two edge surfaces, and forming a mouthpiece, through which a user can generate an airflow past or through the slab in order to inhale an aerosol, by extending the wrapper from the front end surface of the slab.

* * * * *